US005992070A

United States Patent [19]

Birnbaum

[11] Patent Number: 5,992,070

[45] Date of Patent: Nov. 30, 1999

[54] FLEXIBLE FACE SIGN SYSTEM

[75] Inventor: Bruce D. Birnbaum, Overland Park, Kans.

[73] Assignee: The Carter-Water Corporation, Kansas City, Mo.

[21] Appl. No.: 08/818,946

[22] Filed: Mar. 17, 1997

Related U.S. Application Data

[63] Continuation-in-part of application No. 08/416,080, Apr. 4, 1995, abandoned.

[51] Int. Cl.[6] ..... G09F 13/04

[52] U.S. Cl. ..... 40/603; 40/574

[58] Field of Search ..... 40/603, 574

[56] References Cited

U.S. PATENT DOCUMENTS 4,265,039 5/1981 Brooks .
4,542,605 9/1985 Gandy .
4,817,317 4/1989 Kovalak, Jr. .
5,042,182 8/1991 King .
5,140,765 8/1992 King .

*Primary Examiner*—Cassandra H. Davis
*Attorney, Agent, or Firm*—Litman, McMahon & Brown, L.L.C.

[57] ABSTRACT

A flexible face sign system is provided which includes a cabinet assembly mounting one or two face assemblies. The cabinet assembly includes a cabinet frame comprising upper, lower and opposite side cabinet frame sections. The cabinet assembly can receive a light fixture for providing illumination. The face assembly includes a face frame comprising upper, lower and opposite side sections. The cabinet and face upper frame sections are hingedly interconnected whereby the face assembly can be swung to an open position with respect to the cabinet assembly. Alternatively, the face assembly can be removably mounted on the cabinet assembly without providing for hinged motion therebetween. The face assembly includes a flexible face panel mounted on the face frame sections and adjustably stretched thereover by retainer clips which grip margins of the face panel and are tension-adjustably connected to the face frame sections by tension-adjusting bolts. Alternative configurations of trim covers are provided for covering the face frame sides and for providing access to the tension-adjusting bolts.

10 Claims, 7 Drawing Sheets

10
2
68
6
12a
2.
3.
4
22
18
14
12c
20
44c
132
2.
124
14
90
16
120
92
134
3.
118
36
40

Fig.4.
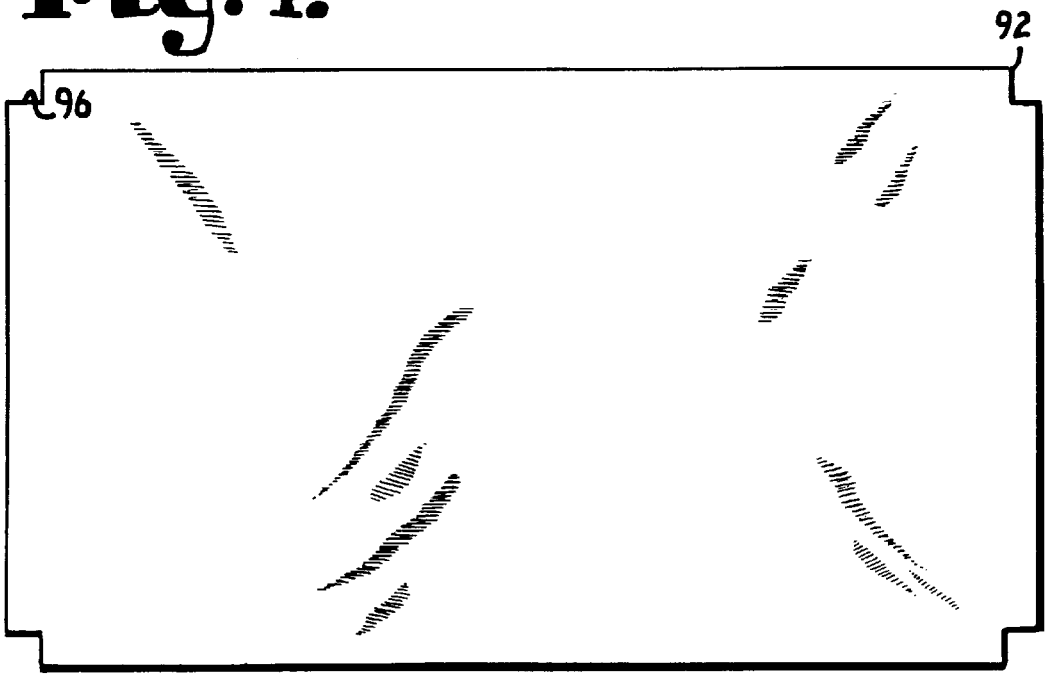
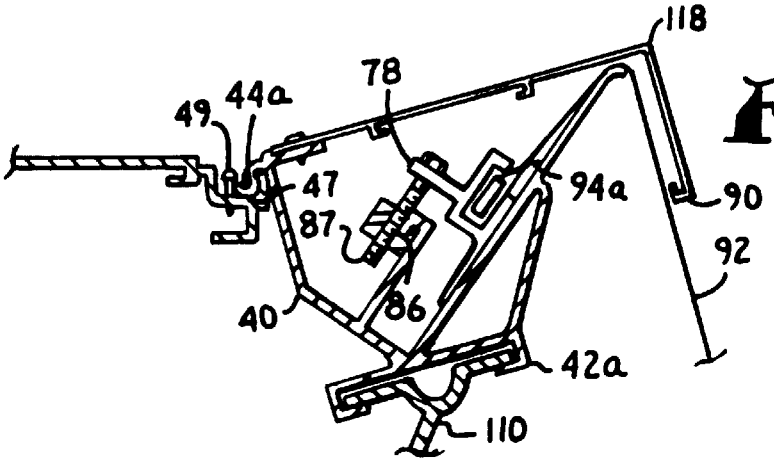
Fig.5.

FLEXIBLE FACE SIGN SYSTEM

CROSS REFERENCE TO RELATED APPLICATIONS

This application is a continuation-in-part of application Ser. No. 08/416,080 entitled FLEXIBLE FACE SIGN SYSTEM, filed Apr. 4, 1995 now abandoned.

BACKGROUND OF THE INVENTION

1. Field of the Invention

The present invention relates generally to sign systems, and in particular to a flexible face sign system for new signs and for retrofitting to existing signs.

2. Description of the Related Art

Signage of various types is in widespread usage for a wide variety of commercial and other purposes. For example, businesses typically employ some type of signage for identification and advertising at their places of business. Signage is used in other applications for communicating, expressing, decorating and for related purposes.

Illuminated signage is a common type used in commercial establishments. Typically a frame mounts one or two translucent faces (for one- or two-sided signage) and contains an illumination source, such as one or more fluorescent light fixtures. Such signs are thus illuminated from within and can provide very effective visual presentations. Thus, an illuminated sign, properly sized, can provide a dramatic display for drawing the attention of potential customers and for communicating therewith.

The faces of such signage can be formed of various plastic materials, including both rigid and flexible materials. Although rigid plastic face materials have several advantages, a disadvantage thereof is that they are susceptible to breakage from vandalism and other causes.

To address some of these disadvantages, flexible materials such as vinyl, plastic-coated canvas, etc. have been employed on flexible face signage. Such materials can be printed with various designs and provide sufficient weather resistance for most applications. Moreover, they are less subject to breakage than rigid plastic faces, and small punctures and tears can be sustained by flexible material faces without significantly compromising the overall appearance of the signage.

Another advantage of flexible sign faces is that they can be rolled up and more easily transported in a compact configuration than large, rigid plastic panels.

The Brooks U.S. Pat. No. 4,265,039 discloses display signs with flexible fabric display faces. However, the construction of the Brooks signage tends to be relatively complex, which complexity could result in higher costs.

The present invention addresses some of the aforementioned disadvantages with prior art signage.

SUMMARY OF THE INVENTION

In the practice of the present invention, a flexible face sign system is provided which includes a cabinet assembly with a cabinet frame formed of longitudinal upper, lower and opposite side sections. A face assembly is provided for mounting on the cabinet assembly and includes a face frame comprising upper, lower and opposite side face frame sections. The face assembly includes a flexible face panel which is secured to the face frame by retainer clips, which provide for selective tensioning of the face panel. Alternative trim cover configurations are provided for covering and enclosing the face assembly sides.

OBJECTS AND ADVANTAGES OF THE INVENTION

The principle objects and advantages of the present invention include: providing a flexible face sign system; providing such a sign system which can be installed on new signage or retrofit on existing signage; providing such a sign system which provides for tensioning a flexible sign face; providing such a sign system which can be assembled from stock lengths of frame sections; providing such a sign system with a face assembly hingedly mounted on a cabinet assembly for accessing an interior thereof; providing such a sign system which can be illuminated; providing such a sign system which can provide alternative face appearances; providing such a sign system which can be largely assembled from extruded aluminum sections; providing such a sign system which is relatively weather resistant; providing such a sign system wherein sign faces thereof can be relatively easily changed; providing such a sign system wherein sign faces thereof can be adjustably tensioned; and providing such a sign system which is economical to manufacture, efficient in operation and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a plan view of the sign face prior to installation.

FIG. 5 is a vertical, cross-sectional view thereof generally showing the upper portion of the sign system shown in FIG. 1 with a face assembly thereof tilted towards an open position.

DETAILED DESCRIPTION OF THE PREFERRED EMBODIMENTS

I. Introduction and Environment

Figure 1:
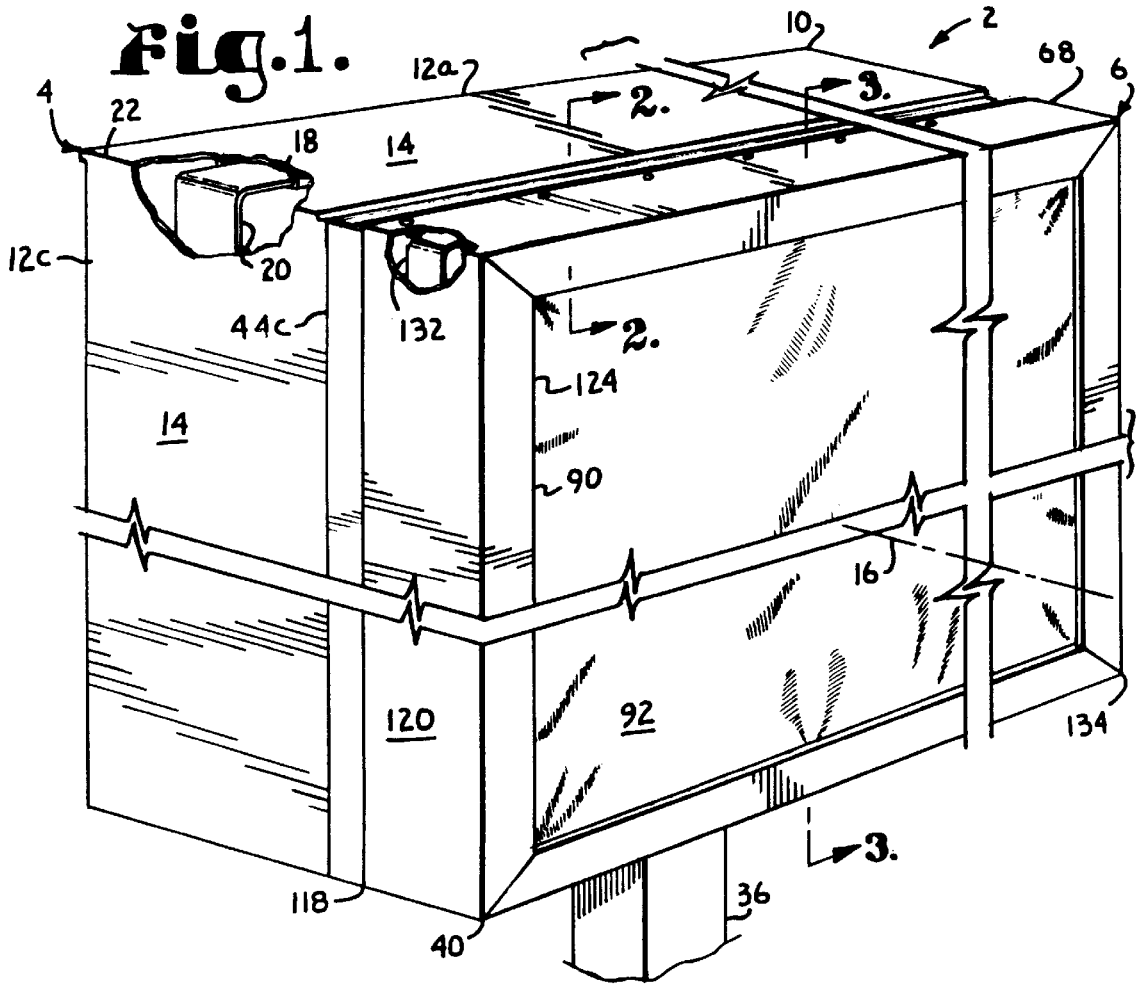
FIG. 1 is an upper, front, fragmentary perspective view of a flexible face sign system embodying the present invention, with portions broken away to reveal internal construction.
Figure 2:
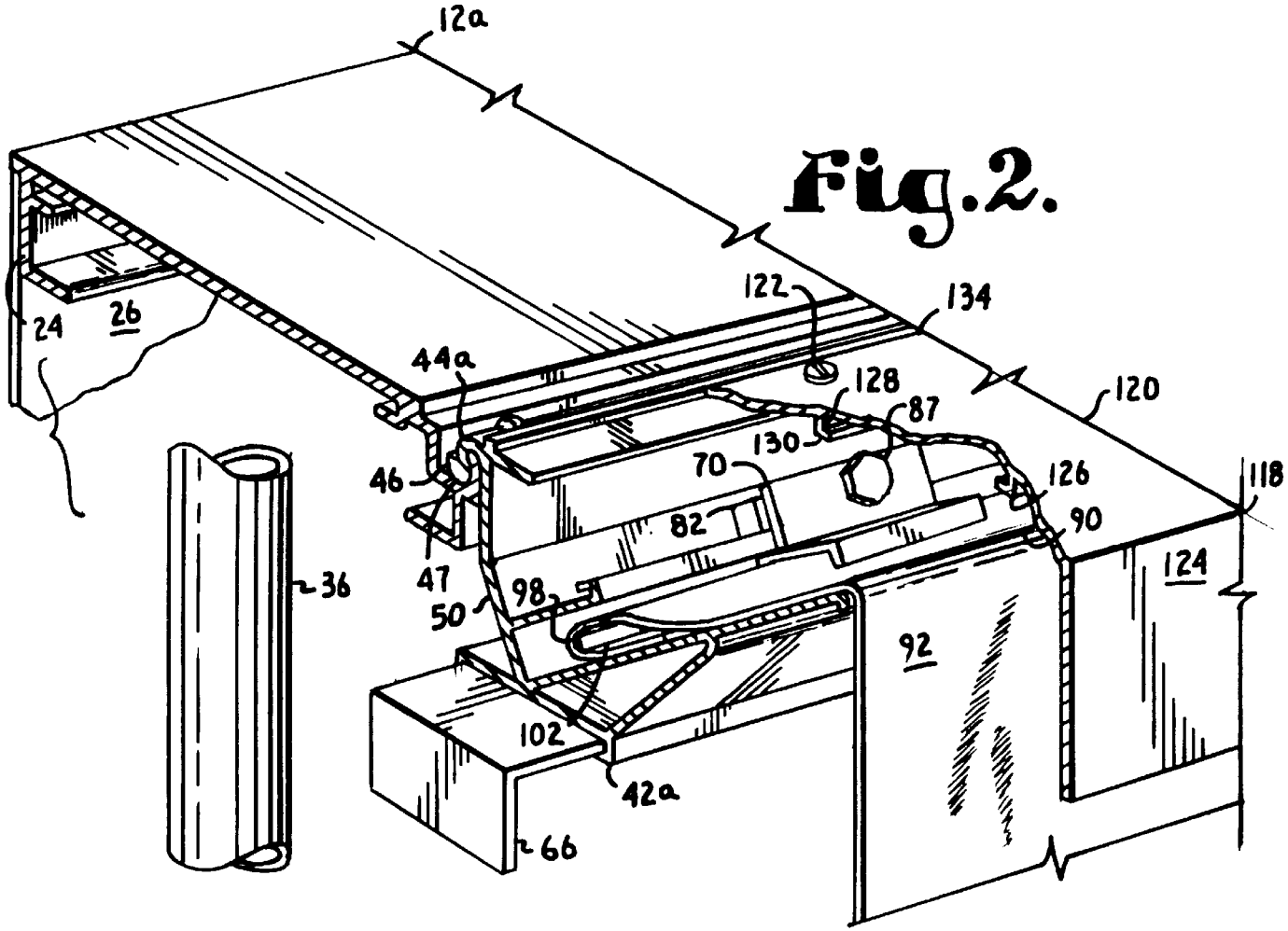
FIG. 2 is an enlarged, fragmentary, perspective view thereof, taken generally along a section line cut at line 2—2 of FIG. 1 and particularly showing the construction of cabinet frame and face frame sections.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly"and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, a flexible face sign system embodying the present invention is generally designated by the reference numeral 2. The sign system 2 generally comprises cabinet and face assemblies 4, 6.

II. Cabinet Assembly 4

The cabinet assembly 4 includes a cabinet frame 10 comprising upper, lower and opposite side sections 12*a*, 12*b*, 12*c* and 12*d* (not shown). Each cabinet frame section 12*a*–12*d* includes a wall 14 extending in a plane generally parallel to and spaced from a sign axis 16. Cabinet frame section connector slots 18 are formed on the insides of the cabinet section frames 12*a*–12*d* and receive angle-section cabinet frame connectors 20 for joining the cabinet frame sections 12*a*–12*d* at respective mitered corners 22.

Each cabinet frame section 12*a*–12*d* includes a back panel mounting leg 24 for mounting a back panel 26 thereto. At the other side thereof each cabinet frame section 12*a*–12*d* also includes a face assembly mounting leg 28 spaced slightly inwardly from the cabinet frame section face 15, thereby forming a shoulder 30. The cabinet frame sections 12*a*–12*d* include hinge channels 32 with curved outer walls 34. The cabinet assembly 4 can be mounted on a suitable pole 36. The cabinet assembly 4 includes illumination means 38 mounted therein, which can comprise, for example, fluorescent light fixtures.

III. Face Assembly 6

Figure 3:
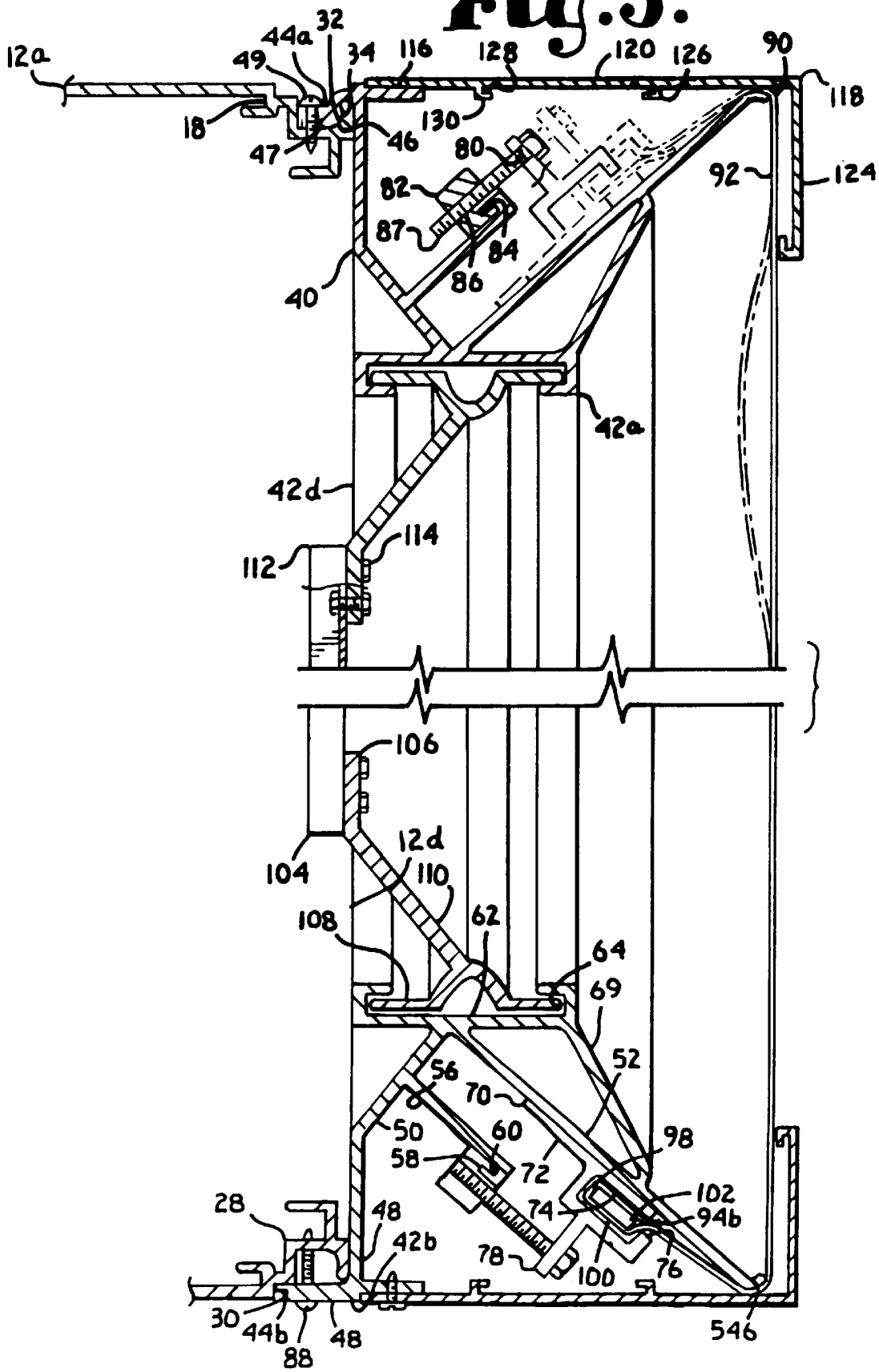
FIG. 3 is a fragmentary, vertical, cross-sectional view thereof, taken generally along line 3—3 in FIG. 1.

The face assembly 6 includes a face frame 40 comprising upper, lower and opposite side sections 42*a*–42*d* respectively. The upper face frame section 12*a* includes a hinged connecting flange 44*a* with a longitudinally-extending, curved hinge member 46 which extends generally inwardly and is selectively and rotatably received in the hinge channel 32 to form a hinge 47. A plurality of keeper screws 49 are threadably screwed into the upper cabinet section 12*a* and located within the hinge channel 32 for engaging the hinge member 46 and retaining or keeping same in place. The face assembly 6 is thus secured to the cabinet assembly 4 with the face assembly 6 in different positions with respect to the cabinet assembly 4, e.g., closed (FIG. 3), or open (FIG. 5).

The remaining face frame sections 42*b*–42*d* include respective connecting flanges 44*b*–44*d* adapted to engage respective face assembly mounting legs 28 in proximity to the cabinet frame section shoulders 30.

Each face frame section 42*a*–42*d* includes a base flange 48 extending generally inwardly from a respective connecting flange 44*a*–*b* and positioned generally parallel to and juxtaposed to the outside of a respective face assembly mounting leg 28. A spacer flange 50 extends along a sloping angle from each base flange 48 in a direction generally towards a location on the sign axis 16 spaced outwardly from the sign system 2. A face extension flange 52 extends from each spacer flange 50 and forms approximately a right dihedral angle therewith and includes an inner edge 54*a* connected to the spacer flange 50 and an outer, free, radiused edge 54*b* which turns slightly inwardly and forms a face border. The face extension flanges 52 are generally oriented in sloping configurations which diverge towards a location on said sign axis 16 spaced inwardly from the face assembly 6. The planes in which the face extension flanges 52 lie can be oriented at approximately 45° with respect to the sign axis 16.

Each face frame section 42*a*–*d* includes a respective anchor flange 56 located generally inwardly from or behind a respective face extension flange 52 and oriented in generally spaced, parallel relationship therewith. Each anchor flange 56 terminates at an anchor return 58 forming an anchor channel 60. The face extension flange inner edges 54*a* and the spacer flanges 50 are connected to respective face frame section channels 62 which have opposed slots 64. The face frame sections 42*a*–*d* are miter-cut at 45° angles at their respective ends, which are connected together by angle section connectors 66 received in respective face frame section channels 62 for forming the connecting flanges 42*a*–*d* into the face frame 40 with mitered corners 68. A stiffener flange 69 extends from the extension flange 52 to the face frame section channel 62.

A plurality of retainer clips 70 are associated with respective face frame sections 42*a*–*d* and each includes a sliding base 72 slidably engaging a respective face extension flange 52 on the outside thereof, a passage 74 open in a direction generally outwardly at a slot 76, and a tab 78 projecting generally laterally outwardly and including a retainer clip receiver 80.

Associated with each retainer clip 70 is a respective anchor 82 including an anchor slot 84 and a female-threaded tension bolt receiver 86. The face frame 40 defines a display field 90 with a face border at the face extension flange outer edges 54*b*.

A flexible face panel 92 has height and length dimensions greater than those of the display field 90 and includes upper, lower and opposite side margins 94*a*–94*d* and cut-out corners 96. Each face panel margin 94*a*–94*d* is folded under itself along a respective face panel fold line 98 to form a respective face panel pocket 100 between double layers of the face panel 92. Each face panel pocket 100 receives a respective retainer bar 102 which is received in a respective retainer clip passage 74 together with a portion of a respective face panel margin 94*a*–*d*.

An optional frame brace subassembly 104 is provided for use in face assemblies 6 which are sufficiently large to require vertical bracing, e.g., face sizes larger than four feet tall and eight feet long. Such frame brace subassemblies 104 should preferably be provided at intervals of no more than four feet on centers. Each frame brace subassembly 104 includes a frame brace 106 with a base 108 slidably received in a respective face frame section channel 62 and an arm 110. A vertical strut 112 is fixedly attached to and extends between respective frame brace arms 110. The vertical strut 112 can be mounted on the arm 110 by two pairs of bolts 114 as shown, or by welding.

Each face frame section 42*a*–42*d* includes a trim cover mounting flange 116 extending from the connecting flange 44*a–d* thereof in an outward direction generally parallel to said sign axis 16. A trim cover 118 includes a base leg 120 attached, e.g., by screws 122, to a trim cover mounting flange 116 and a face leg 124 extending over a portion of the face panel 92 within the display field 90. The trim covers 118 include integral, inner projections 126 forming opposed grooves 128 for receiving respective legs of angle-section trim cover joiners 132 at the frame corners 68 whereby the trim covers 118 form a trim cover frame 134.

IV. Manufacture and Operation

The flexible face sign system 2 can comprise any suitable materials, such as extruded aluminum for the cabinet and face frame sections 12*a–d,* 42*a–d*. Various other components can also comprise suitable aluminum sections which can be extruded, cast, stamped, etc. Aluminum has the advantage of being relatively easy to work and relatively weather resistant. The longitudinal components of the flexible face sign system 2 can be formed by extrusion or some other suitable process. The longitudinal components, such as the cabinet and face frame sections 12*a–d,* 42*a–d* and the trim covers 118 can be extruded in predetermined lengths and thereafter cut (e.g., with a miter or cut-off saw) to specific lengths as required for the fabrication of finished sign systems 2 having desired dimensions. In this manner standard lengths of the components can be stocked by a sign fabricator and cut to length for creating custom signage for its customers. The cabinet and face frame sections 12*a–d,* 42*a–d* can also be spliced together from precut or stock lengths of extruded aluminum components for sign systems 2 with relatively long dimensions, for example, lengths which exceed the lengths of the stock components.

The face panel 92 can likewise comprise a suitable flexible material, which can be imprinted with various text, designs and other indicia. The face panel 92 material can be chosen for its characteristics such as weather resistance, strength, translucence, etc.

The components of the flexible face sign system 2 can be assembled by any suitable means such as welding, screws, adhesive, etc.

The face panel 92 is mounted by first notching three inch squares from the corners of the trimmed face material to provide the cut-out corners 96. Approximately two and one-half inches of the face panel 92 adjacent the margins 94*a–b* can then be folded along the fold lines 98 over the bars 102, which can be approximately four inches long. The bars 102 should preferably be spaced approximately ten inches on centers, and within tree to four inches from the margins 94*a–d*. The retainer clips 70 are slid over and generally centered on the bars 102 with the face panel pockets 100 captured within the retainer clip passages 74. The face panel 92 can then be placed over the face frame 40 and tensioned by means of tensioning bolts 87 threadably received in anchor receivers 86 and rotatably received in retainer clip receivers 80. The tensioning bolts 87 are accessible with the trim covers 118 removed whereby periodic adjustments of the tension in the face panel 92 can be accomplished.

The face assembly 6 is mounted on the cabinet assembly 4 by engaging the hinge member 46 in the hinge channel 32 to form the hinge 47 which is secured by the keeper screws 49. Additional face assembly mounting screws 88 extend through the face frame section connecting flanges 44*b*–44*d* and into the face assembly mounting legs 28 of the cabinet frame sections 12*a*–12*d*. Access to the interior of the cabinet assembly 4 can be obtained by detaching (e.g., unscrewing) the lower and side face frame sections 42*b–d* from the corresponding cabinet frame sections 12*b–d,* and swinging the face assembly 6 upwardly by means of the hinge member 46.

V. First Modified Embodiment Flexible Face Sign System 202

Figure 6:
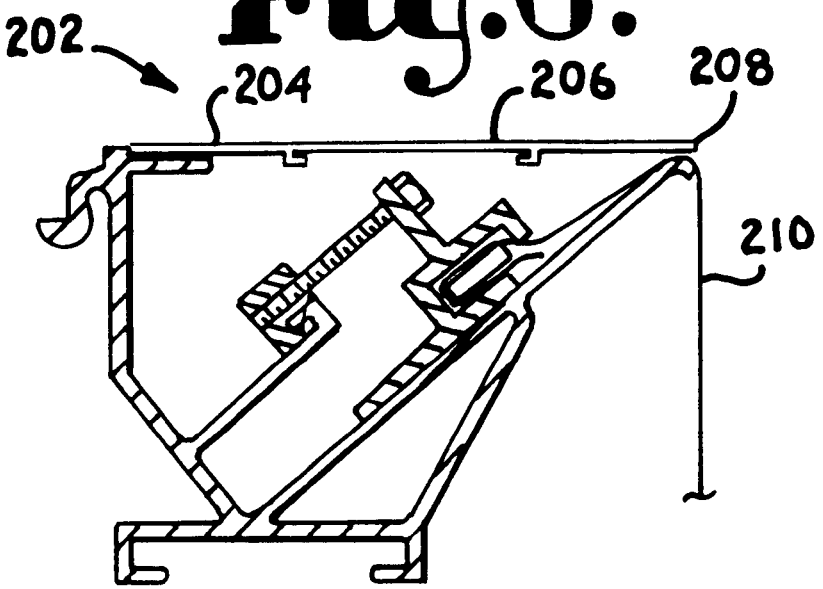
FIG. 6 is a vertical, cross-sectional view of a flexible face sign system comprising a first modified or alternative embodiment of the present invention, showing an alternative trim cover design.

FIG. 6 shows a flexible face sign system 202 comprising a first modified or alternative embodiment of the present invention. The flexible face sign system 202 includes a modified trim cover 204 with a single base leg 206 terminating at a free edge 208 adjacent the face extension flange outer free edges 54. The trim covers 204 provide a "bleed" style of face assembly 210 whereby substantially the entire display field 90 is visible and exposed.

FIG. 6 shows the bleed style trim cover 204 mounted on the hinged face frame section 42*a* which would hingedly connect to an upper cabinet frame section 12*a*.

VI. Second Modified Embodiment Flexible Face Sign System 262

Figure 7:
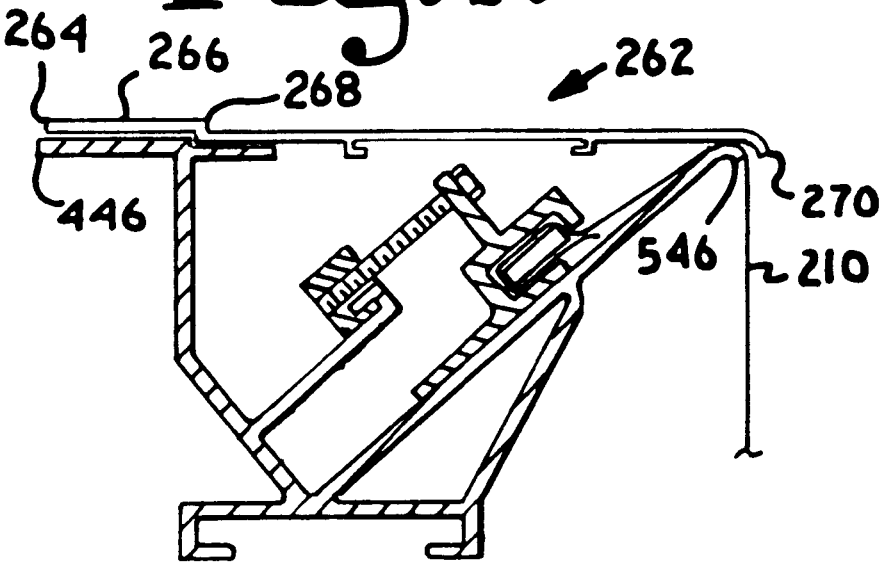
FIG. 7 is a vertical, cross-sectional view of a flexible face sign system comprising a second modified or alternative embodiment of the present invention, showing another alternative trim cover design.

FIG. 7 shows a flexible face sign system 262 comprising a second modified or alternative embodiment of the present invention with a modified trim cover 264 having a transition section 266 for covering the face frame section connecting flange 44*b,* a shoulder 268, and a front, radiused free edge 270 covering the face extension flange outer edge 54*b*.

VII. Third Modified Embodiment Flexible Face Sign System 252

Figure 8:
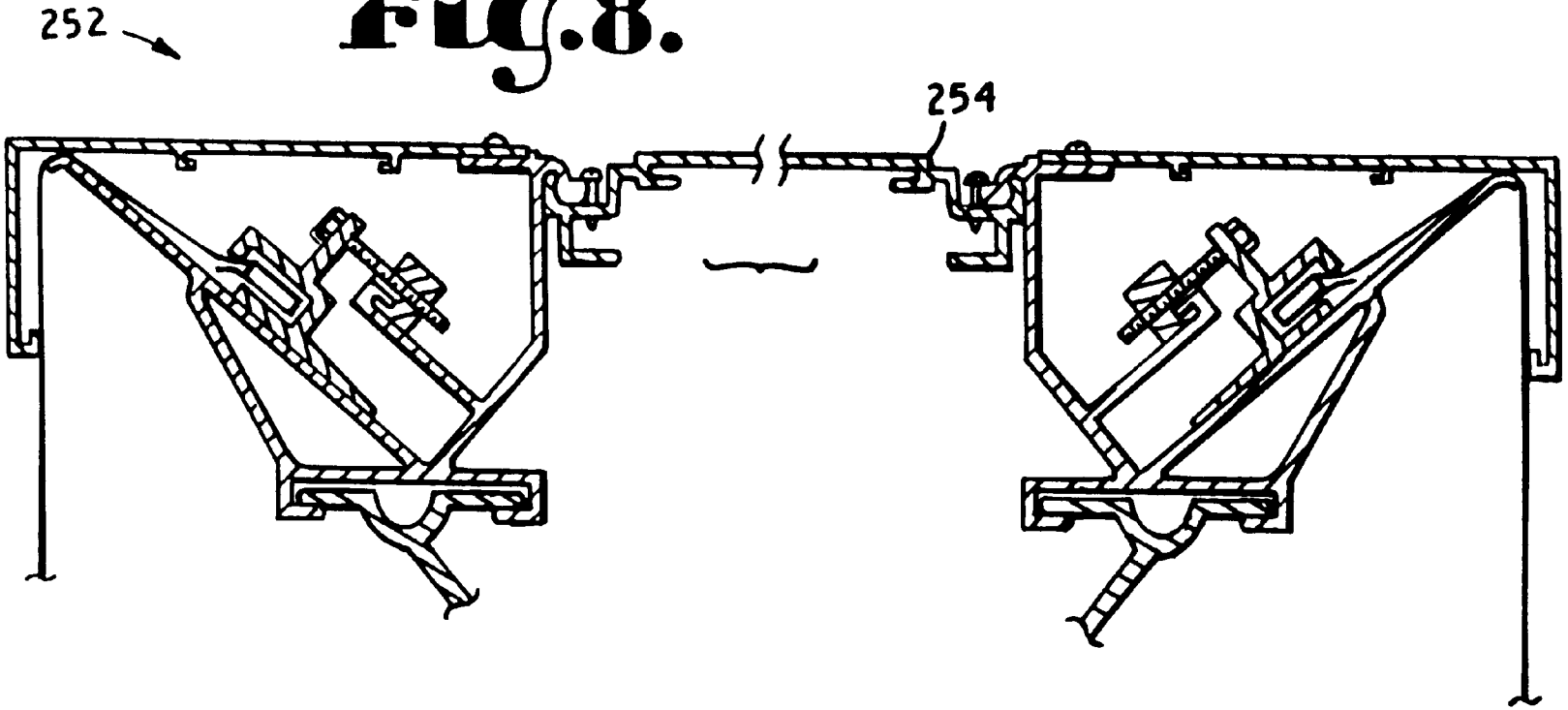
FIG. 8 is a vertical, cross-sectional view of a flexible face sign system comprising a third modified or alternative embodiment of the present invention, shown in a two-faced sign configuration.

FIG. 8 shows a flexible face sign system 252 adapted to a double-faced signage configuration with a pair of face assemblies 6 and a double-faced cabinet assembly 254, which can assume various widths.

VIII. Fourth Modified Embodiment Flexible Face Sign System 302

Figure 9:
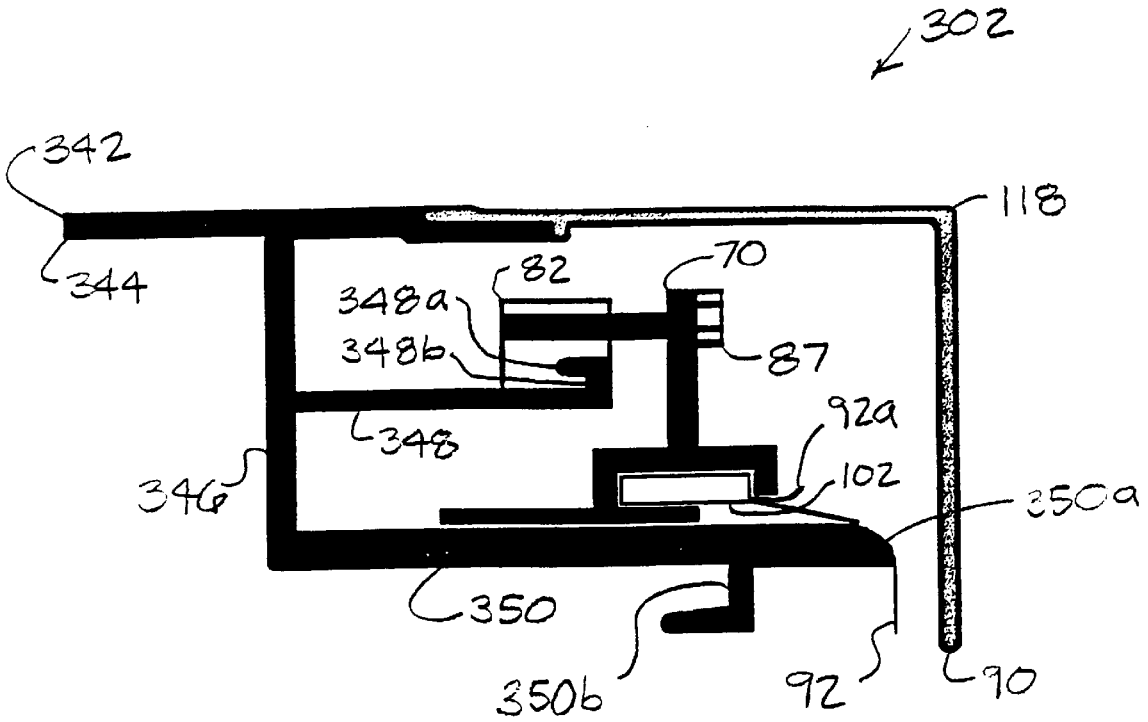
FIG. 9 is a vertical, cross-sectional view of a flexible face sign system comprising a fourth modified or alternative embodiment of the present invention, showing an alternative face frame section configuration.

FIG. 9 shows a flexible face sign system 302 comprising a fourth modified or alternative embodiment of the present invention with a modified face frame section 342. The face frame section 342 includes a connecting flange 344 for attachment to a cabinet assembly 4 in the manner described above. Alternatively, the connecting flange 344 could comprise a hinge member 46 as described above for hingedly mounting the flexible face sign system 302 on a cabinet assembly 4.

A base flange 346 extends generally perpendicularly from the connecting flange 344 in a direction inwardly with respect to the cabinet assembly 4. Anchor and face extension flanges 348, 350 respectively extend outwardly from the base flange 346 in a generally parallel relation with respect to the connecting flange 344, with the anchor flange 348 being located intermediate the connecting and face extension flanges 344, 350 respectively. The anchor flange 348 terminates at an anchor return 348*a* which forms a rearwardly-open anchor flange channel 348*b*.

The face extension flange 350 terminates at a rounded, free edge 350*a* over which the face panel 92 is placed. The face extension flange 350 also include a face extension flange slot 350*b* which can receive a frame brace subassembly base 108 as described above. The anchor and face extension flanges 348, 350 mount a plurality of retainer clips 70 and anchors 82 as described above. The retainer clips 70 receive respective face panel margins 94*a,b,c,d* which are folded double and receive respective retainer bars 102 for anchoring the face panel margins 94*a,b,c,d* in the manner described above. Trim covers 118 as described above are mounted on the connecting flanges 344 of the face frame section 342.

In operation, the modified face frame sections 342 function in a manner similar to the face frame sections 42 described above. An advantage to the modified face frame sections 342 is that the face extension flange free edges 350*a* are positioned closer to a display field 90 framed by the trim covers 118 whereby a larger area of the face panel 92 is visible within the display field 90 than with the face assembly 6 described above. Moreover, the modified face frame sections 342 can be configured for extruding or forming with less material than the face frame sections 42 described above. Otherwise, manufacture, assembly, installation, operation and maintenance of the modified flexible face sign system 302 is similar to the flexible face sign systems 2, 142 and 262 described above.

It is to be understood that while certain forms of the present invention have been illustrated and described herein, it is not to be limited to the specific forms or arrangement of parts described and shown. The face assembly 6 is adapted for use in a new sign system 2, or for retrofit to an existing sign system.

What is claimed and desired to be secured by Letters Patent is as follows:

1. A flexible face assembly for a sign system including a cabinet assembly with a cabinet frame having cabinet frame upper, lower and opposite side sections, which flexible face assembly comprises:

(a) a face frame including:
  (1) upper, lower and opposite side face frame sections;
  (2) each said face frame section having a face extension flange extending generally outwardly from said sign; and
  (3) each said face frame section including an anchor flange extending generally parallel with respect to a respective face extension flange and having an anchor flange return forming an anchor flange channel open generally rearwardly;

(b) a flexible sign face comprising a flexible material and including:
  (1) upper, lower and opposite side margins; and
  (2) upper, lower and opposite side double-folded portions at said upper, lower and opposite side margins respectively;

(c) each said face frame section having a plurality of discrete anchor subassemblies positioned in spaced relation along said face frame section, each said anchor subassembly including:
  (1) an anchor block having a slot selectively receiving a respective anchor flange return and a female-threaded receiver; and
  (2) a tension-adjusting bolt threadably received in said anchor receiver, (d) a plurality of discrete retainer clips each associated with a respective anchor subassembly and including:
  (1) a retainer clip base slidingly engaging a respective face extension flange for sliding inwardly and outwardly thereon;
  (2) a longitudinally-extending passage;
  (3) a longitudinally-extending slot open to said passage; and
  (4) a tab with a receiver rotatably receiving a respective tension-adjusting bolt;

(e) a plurality of rigid, longitudinal members each selectively received in a respective retainer clip passage and being received within a respective double-folded portion of said flexible cover with said double-folded cover portion also being received within said passage and extending through a respective slot; and (f) face assembly mounting means for mounting said face assembly on said cabinet frame sections.

2. The face assembly according to claim 1, which includes:

(a) a pair of said face frame sections each having a slot open inwardly; and (b) a pair of frame braces each having an end tab slidably received in a respective said slot and an arm extending generally inwardly with respect to said sign system; and (c) a strut extending between and connecting said arms.

3. The face assembly according to claim 1, which includes:

(a) a trim cover frame including upper, lower and opposite side trim cover sections each mounted on a respective face frame section.

4. The face assembly according to claim 1, wherein said face frame sections comprise extruded aluminum.

5. The face assembly according to claim 1 which includes a plurality of angle section connectors each connecting a pair of face frame sections at a respective face frame corner.

6. The face assembly according to claim 1, wherein:

(a) said flexible sign face includes notched corners adapted for folding on said face frame sections.

7. The face assembly according to claim 1, which includes:

(a) illumination means within said cabinet.

8. The invention of claim 1, which includes:

(a) hinge means for hingedly interconnecting said cabinet frame upper section with said face frame upper section.

9. The invention of claim 8 wherein:

(a) said hinge means comprises a hinge channel formed in one of said cabinet frame upper section and said face frame upper section and being generally open upwardly; and (b) the other of said cabinet frame upper section and said face frame upper section having a longitudinally extending hinge flange rotatably receivable in said hinge channel.

10. A flexible face sign system, which includes:

(a) a cabinet assembly having a cabinet frame with upper, lower and opposite side cabinet frame sections;

(b) said cabinet frame upper section including a longitudinally-extending rounded channel open in an outward direction;

(c) each said cabinet frame section including a front edge and a shoulder formed thereat;

(d) cabinet frame corner connection means for connecting said cabinet frame sections at corners of said cabinet frames;

(e) a sign axis extending in a direction generally normal to a face of said sign, each said cabinet frame section extending generally perpendicularly and in spaced relation with respect to said sign axis;

(f) a face assembly including:
  (1) a face frame comprising upper, lower and opposite side face frame sections;
  (2) each said face frame upper section having a hinge flange with a rounded edge, said hinge flange being rotatably received in said cabinet frame upper section hinge channel;
  (3) each of said lower and opposite side face frame sections including a connecting flange selectively receivable in a respective cabinet frame section shoulder;
  (4) each said face frame section having a base flange extending from a respective hinge or connecting flange, each said base flange being located generally within a plane perpendicular to said sign axis;

(5) each said face frame section having a spacer flange extending generally towards a location on said sign axis spaced outwardly from said face frame assembly;

(6) each said face frame section having a face extension flange sloping generally outwardly from said sign axis and from said sign system;

(7) each said face frame section including an anchor flange extending generally parallel with respect to a respective face extension flange and having an anchor flange return forming an anchor flange channel open generally6 inwardly;

(8) each said face extension flange terminating at a free edge with a rounded configuration;

(9) each said face frame section including a face frame channel with a pair of edge slots positioned in opposing relation, said face frame section channel being inwardly open; and

(10) each said face frame including a stiffener flange extending between a respective face extension flange and a respective face frame channel;

(g) a plurality of discrete anchor subassemblies each associated with a respective face flange section and including:

(1) an anchor block having a tab selectively receivable in a respective anchor flange channel and a female-threaded receiver; and (2) a tension-adjusting bolt threadably received in said anchor receiver;

(h) a plurality of discrete retainer clips each associated with a respective anchor subassembly and including a passage extending longitudinally through and open at a slot oriented generally outwardly with respect to said sign system, each said retainer clip including a tab with a receiver rotatably receiving a respective tension-adjusting bolt, each said retainer clip further including a retainer clip base slidingly engaging a respective face extension flange for sliding inwardly and outwardly thereon;

(i) a flexible face panel including upper, lower and opposite side margins, a height created at a height defined by said display field and a width greater than a width defined by said display field;

(g) a plurality of retainer bars, each being folded within a respective double-folded face panel margin and slidably received together with a portion of said double-folded face panel margin within a respective retainer clip passage;

(k) a pair of frame braces each including a base slidable received in a respective face frame section channel and captured with the slots thereof and an arm extending generally towards said sign axis and inwardly with respect to said cabinet; and (l) a vertical strut mounted on said frame brace arms and extending generally vertically within said cabinet.

* * * * *